US005695432A

United States Patent [19]

Söderlund

[11] Patent Number: 5,695,432

[45] Date of Patent: Dec. 9, 1997

[54] AN ARRANGEMENT FOR PRACTIZING WALKING

[75] Inventor: Bengt Patrick Söderlund, Lund, Sweden

[73] Assignee: Tranås Rostfria AB, Tranås, Sweden

[21] Appl. No.: 809,053

[22] PCT Filed: Sep. 23, 1994

[86] PCT No.: PCT/SE94/00879

§ 371 Date: Mar. 10, 1997

§ 102(e) Date: Mar. 10, 1997

[87] PCT Pub. No.: WO96/09094

PCT Pub. Date: Mar. 28, 1996

[51] Int. Cl.[6] ..... A63B 22/00

[52] U.S. Cl. ..... 482/69

[58] Field of Search ..... 482/23, 51, 54, 482/66, 69, 70, 92, 95, 96, 98, 101, 903

[56] References Cited

U.S. PATENT DOCUMENTS

| | | | |
|---|---|---|---|
| 3,999,228 | 12/1976 | Thomas . | |
| 4,164,350 | 8/1979 | Zeijdel et al. . | |
| 4,410,175 | 10/1983 | Shamp . | |
| 4,861,021 | 8/1989 | Edwards et al. | 482/69 |
| 5,050,590 | 9/1991 | Futakami . | |
| 5,221,241 | 6/1993 | Bare | 482/27 |
| 5,273,502 | 12/1993 | Kelsey et al. . | |

FOREIGN PATENT DOCUMENTS

| | | | |
|---|---|---|---|
| 0 272 786 | 6/1988 | European Pat. Off. . | |
| 0 304 538 | 3/1989 | European Pat. Off. . | |
| 8606644 | 11/1986 | WIPO | 482/112 |

*Primary Examiner*—Richard J. Apley
*Assistant Examiner*—Glenn E. Richman
*Attorney, Agent, or Firm*—Browdy and Neimark

[57] ABSTRACT

An arrangement for practizing walking comprises a treadmill (10) serving as a walking substrate, a harness (14) which may be mounted on a patient (11), a suspension cable (16) connectable to the harness, and a device (19) by which a lifting force of an adjustable magnitude may be applied on the patient (11) through the cable (16) and the harness (14). Said device (19) comprises a pulley (20) around which the cable (16) extends in a bight (41). This pulley (20) is arranged for limited movement in a direction transverse to its rotary axis (22) in order to permit a limited variation of the length of said bight (41). By means of an elastically yieldable force generating means (30), an adjustable force, which is substantially independent of the instantaneous position of said pulley (20), may be applied on the pulley (20) in a direction to cause said bight (41) of the cable (16) to assume its maximum length.

6 Claims, 1 Drawing Sheet

AN ARRANGEMENT FOR PRACTIZING WALKING

BACKGROUND OF THE INVENTION

1. Technical Field of the Invention

The present invention relates to an arrangement for practising walking.

More particularly, the invention relates to such an arrangement of the kind, comprising a powered treadmill, serving as a walking substrate, and means for unloading a patient standing on the treadmill of at least a portion of his body weight, said means comprising a harness which may be mounted on the patient and a suspension cable which may be connected to the harness with its one end and which extends from said end in an upward direction to a first pulley or other diversion means and then to a device by which a lifting force of an adjustable magnitude may be applied on the patient through the cable and the harness.

Arrangements of the above kind may be utilized for practising walking by patients having a reduced walking capability, caused by an illness or an accident, for instance by stroke patients suffering from hemiparesis. A special advantage of these arrangements is that the walking practice may be started at a very early stage and that it may be effected with a minimum effort of assisting personnel. Moreover, the arrangements may be made compact enough to make it possible, without difficulty, to install them also in relatively small treatment rooms.

2. Prior Art

Previously known arrangements of the above kind have been of primarily two different types. In arrangements of the first type, the magnitude of the lifting force is set by the step of, after having placed the patient standing on the treadmill, securing the cable against movement in its longitudinal direction in a position in which it applies the desired lifting force on the patient. When the treadmill is started and the patient begins to carry out walking movements thereon, the fact that the harness is held fixed at a constant level by the cable results in that the movements of the patient will cause a substantial variation in the magnitude of the lifting force applied on the patient. This results in that the patient will move according to a pattern which is strongly distorted in relation to a normal walking pattern.

In arrangements of the second type, a substantial improvement of the walking pattern of the patient is obtained as a consequence of the fact that the cable is not secured against movements in its longitudinal direction but instead, at its end distant from the harness, loaded by a counterweight of variable size which produces the desired lifting force. The movement pattern of the patient is hereby substantially improved. However, even in this case, it will deviate from the normal walking pattern. The reason is that the movements of the patient transmitted to the counterweight through the cable will give rise to acceleration and retarding forces which are caused by the high mass of the counterweight and which are superimposed on the lifting force, which is dependent on the weight of the counterweight, and which result in that the patient will move in an affected manner.

OBJECT AND SUMMARY OF THE INVENTION

The invention has for its purpose to provide an improved arrangement of the kind initially specified, in which the lifting force may be maintained substantially constant despite the movements carried out by the patient.

The arrangement according to the invention proposed for said purpose is primarily characterized in that said device comprises a second pulley or other diversion means around which the cable extends in a bight on its way from the first pulley to an anchoring means for its other end, the second pulley being arranged for limited movement in a direction transverse to its rotary axis in order to permit a limited variation in the length of said bight of the cable, and the second pulley being subjected to the action of an elastically yieldable force generating means which is arranged to apply an adjustable force, substantially indepedent of the instantaneous position of the second pulley, on said pulley in a direction to cause said bight of the cable to assume its maximum length.

The above-mentioned construction of the device serving to apply a lifting force on the patient results in that it will be possible to obtain a sufficiently large amplitude of movement of the harness while simultaneously permitting the total mass of the elements movable in unison with the cable to be kept sufficiently low to prevent those elements from giving rise to any appreciable acceleration and retarding forces.

In order to reduce the movement amplitude of the second pulley required to achieve the desired movement amplitude of the harness and to obtain a constant relationship between the magnitude of the movements of the second pulley and the magnitude of the simultaneous movements in a vertical direction of the harness, said bight of the cable may preferably comprise two approximately parallel cable parts, each of which extends towards the second pulley from a respective pulley or other diversion means provided in a stationary position at the open end of the bight.

The force generating means may suitably consist of a pressure controlled means which is arranged, upon the supply of a gas or air under pressure thereto, to generate a force having a magnitude depending on the pressure of the supplied gas or air, respectively. Preferably, said means may consist of a piston and cylinder arrangement of a rolling membrane type. In order to make sure that the generated force will be substantially independent of the instantaneous position of the second pulley, the arrangement may comprise a pressure equalizing tank connected to the force generating means.

The anchoring means for the other end of the cable may suitably consist of a winch which is provided with a cable drum on which the cable may be wound with a variable length of its portion located closest to said end.

BRIEF DESCRIPTION OF THE DRAWINGS

Below the invention is further described with reference to the accompaying drawings, in which.

Figure 1:
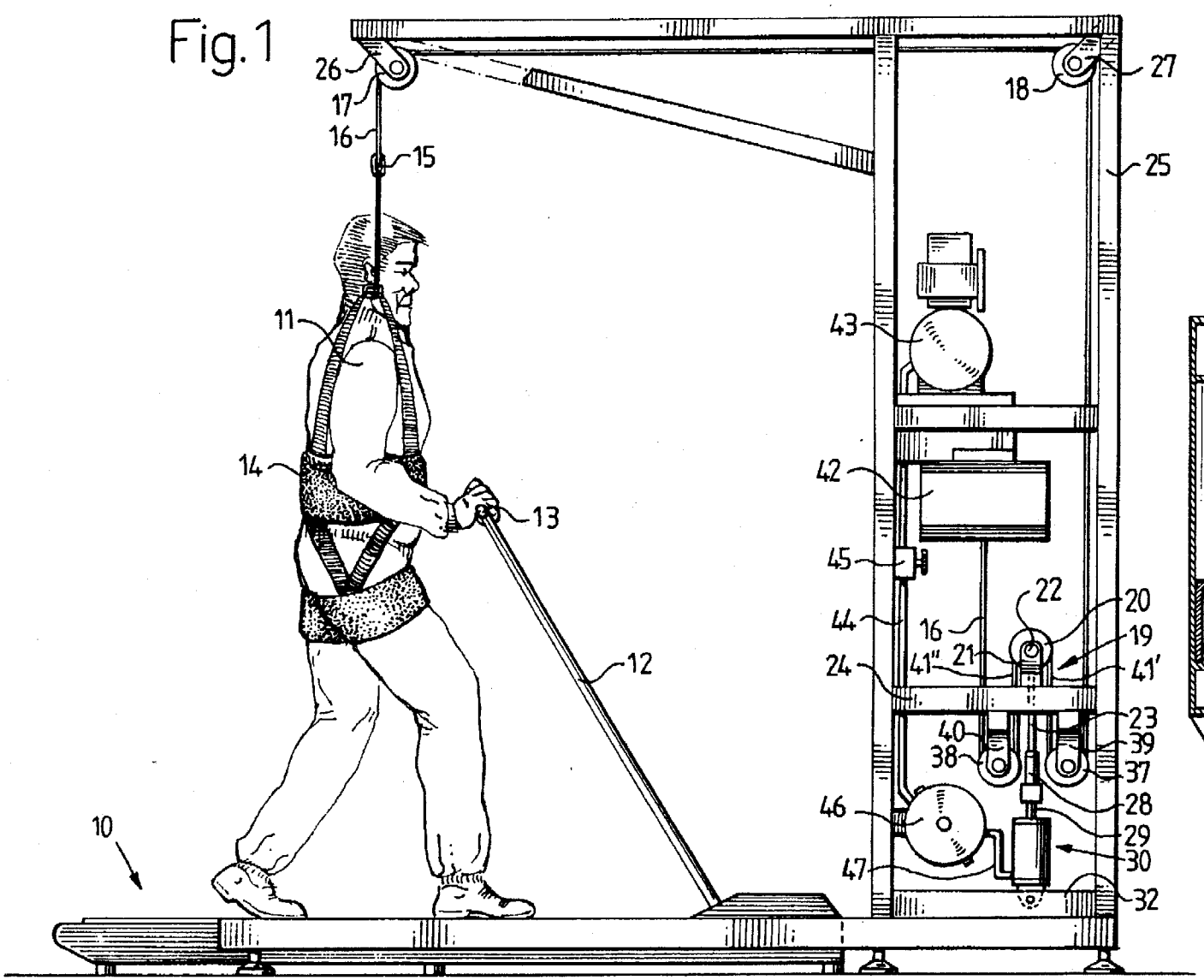
FIG. 1 shows a side elevation of an arrangement for practising walking according to an embodiment of the invention, selected by way of example.

The arrangement shown in FIG. 1 comprises a powered treadmill generally designated 10 and serving as a walking substrate for a patient 11. This treadmill may be of any suitable known kind, for instance of the kind marketed by Rodby Innovation AB, Enhörna, Sweden, and designated Rodby Treadmill RL 1600. Treadmill 10 comprises an endless mat which runs around rollers provided at its ends and the upper part of which is supported in a suitable manner along its length in order to form a walking substrate which may be driven in its longitudinal direction. Reference numeral 12 designates a rod which extends in an inclined upward direction from a front portion of the body of treadmill 10 and which, at its upper end, is provided with a transverse handle 13 serving as a support handle for patient 11.

DETAILED DESCRIPTION OF THE PREFERRED EMBODIMENT(S) OF THE INVENTION

Reference numeral 14 designates a harness which may be mounted on patient 11 and which for instance may be of a kind similar to that utilized by mountaineers. At its upper end, said harness may be connected to one end 15 of a suspension cable 16 by means of which a lifting force may be applied on patient 11 in order to unload him from a portion of his body weight. From end 15, connected to harness 14, suspension cable 16 extends in an upward direction to a first pulley 17, which is rotatably mounted in a position above treadmill 10, and then via a further rotatably mounted pulley 18 to a device generally designated 19, by means of which a lifting force of an adjustable magnitude may be applied on patient 11 through suspension cable 16 and harness 14.

Said device 19 comprises a pulley 20 which is rotatably mounted in a yoke-shaped bracket 21 for rotation in relation thereto around a transverse axis 22. Bracket 21 is mounted at the upper end of a vertical rod 23 which is mounted for displacement in its longitudinal direction in a horizontal connecting member 24 of a stand 25 which is built as a framework and supports the two pulleys 17 and 18 previously mentioned by means of stationary brackets 26 and 27, respectively. At its lower end, rod 23 is connected through a force sensor 28 to the free end of a piston rod 29 which projects in an upward direction from a piston and cylinder arrangement generally designated 30 and the cylinder 31 of which is mounted on a horizontal member 32 of stand 25.

Figure 2:
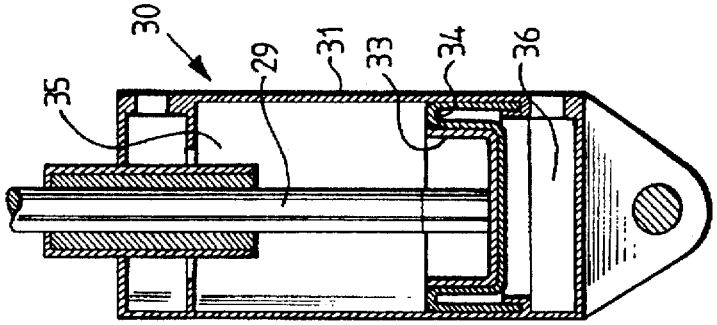
FIG. 2 shows a detailed view, in section, of a pneumatically controlled piston and cylinder arrangement, forming part of the arrangement according to FIG. 1.

As shown in FIG. 2, piston and cylinder arrangement 30 may suitably be of a rolling membrane type and have a flexible membrane 34 which is provided between cylinder 31 and piston 33 and sealingly separates the chamber 35 within cylinder 31 located above the piston from the chamber 36 located below the piston. Such a construction of the piston and cylinder arrangement offers the advantage of making it possible to avoid high frictional forces between the piston and the cylinder.

Reference numerals 37 and 38 designate two further pulleys which are rotatably mounted each in one bracket 39 and 40, respectively, fixed to member 24 at the lower side of said member. The two pulleys 37 and 38 are located in such positions in relation to each other and in relation to the movable pulley 20 as to permit cable 16 to extend around pulley 20 in a bight 41 comprising two substantially parallel parts 41' and 41". From pulley 38 cable 16 extends in a upward direction to a winch 42 which is provided with a cable drum, not shown, on which the cable may be wound with a variable length of its end portion located distant from harness 14.

For the purpose of creating a pressure in piston and cylinder arrangement 30 and generating a lifting force of variable magnitude which may be applied on patient 11 through the movable pulley 20 and cable 16 and harness 14, there is provided an air compressor 43 from which compressed air may be fed through a conduit 44, containing an adjustable reduction valve 45, to a pressure equalizing tank 46, which communicates with the lower chamber 36 in cylinder 31 via a further conduit 47. The volume of tank 46 is very large as compared to the maximum volume of chamber 36. Hereby it is possible to avoid that the pressure in chamber 36, which may be adjusted by means of valve 45, will be influenced to any substantial degree by any movements of piston 33 caused by movements of the patient. Device 19 may hereby generate a force which may be set by means of valve 45 and which is substantially independent of the instantaneous position of piston 33 and pulley 20. This means that, during the practical use of the arrangement above described, it is possible to set the desired level of the harness by means of winch 42 while the desired lifting force may be set by means of valve 45.

I claim:

1. A device for practising walking, comprising a powered treadmill, serving as a walking substrate, and means for unloading a patient standing on the treadmill of at least a portion of his body weight, said means comprising a harness which is mounted on the patient and a suspension cable which is connected to the harness by a first end of the suspension cable and which extends from said first end in an upward direction to a first pulley means and then to a device by which a lifting force of an adjustable magnitude is applied on the patient through the cable and the harness, wherein said device (19) comprises a second pulley means (20) around which the cable (16) extends in a bight (41) from the first pulley means (17) to an anchoring means (42) for a second end of the suspension cable, the second pulley means (20) being arranged for limited movement in a direction transverse to a rotary axis of the second pulley means (22) in order to permit a limited variation in the length of said bight (41) of the cable, and the second pulley means (10) being subjected to an action of an elastically yieldable force generating means (30) which is arranged to apply an adjustable force on said second pulley means, substantially independent of an instantaneous position of the second pulley means (20), in a direction to cause said bight (41) of the cable to assume a maximum length.

2. A device according to claim 1, wherein said bight (41) of the cable (16) comprises two approximately parallel cable parts (41', 41"), each of which extends towards the second pulley means (20) from a respective third pulley means (37, 38) provided in a stationary position at the open end of the bight (41).

3. A device according to claim 1, wherein the force generating means consists of a pressure controlled means (30) which is arranged, upon the supply of a gas or air under pressure thereto, to generate a force having a magnitude depending on the pressure of the supplied gas or air, respectively.

4. A device according to claim 3, wherein the force generating means consists of a piston and cylinder arrangement (30) of a rolling membrane type.

5. A device according to claim 3, wherein it comprises a pressure equalizing tank (46) connected to the force generating means (30).

6. An arrangement according to claim 1, wherein the anchoring means for the second end of the suspension cable (16) consists of a winch (42) which is provided with a cable drum on which the cable (16) is wound with a variable length of the suspension cable portion located closest to said second end of the suspension cable.

* * * * *